US005160097A

United States Patent [19]

Josefsson et al.

[11] Patent Number: 5,160,097

[45] Date of Patent: Nov. 3, 1992

[54] YARN STORAGE AND FEED DEVICE

[75] Inventors: Pär Josefsson, Borås; Alf Bengtsson, Fritsla, both of Sweden

[73] Assignee: IRO AB, Ulricehamn, Sweden

[21] Appl. No.: 674,372

[22] PCT Filed: Oct. 5, 1989

[86] PCT No.: PCT/EP89/01166

§ 371 Date: Jun. 3, 1991

§ 102(e) Date: Jun. 3, 1991

[87] PCT Pub. No.: WO90/04058

PCT Pub. Date: Apr. 19, 1990

[30] Foreign Application Priority Data

Oct. 7, 1988 [DE] Fed. Rep. of Germany ..... 3834231
Oct. 17, 1988 [DE] Fed. Rep. of Germany ..... 3835319
Oct. 28, 1988 [DE] Fed. Rep. of Germany ..... 3836833

[51] Int. Cl.[5] ..... B65H 51/20; B65H 57/24

[52] U.S. Cl. ..... 242/47.01; 242/157 R

[58] Field of Search ..... 242/47.01, 47.12, 157 R; 66/132 R, 132 T; 139/452

[56] References Cited

U.S. PATENT DOCUMENTS

| | | | |
|---|---|---|---|
| 3,080,134 | 3/1963 | England et al. | 242/157 R |
| 3,080,135 | 3/1963 | Steijn | 242/157 R |
| 3,696,604 | 10/1972 | Nozaki et al. . | |
| 3,787,229 | 1/1974 | Rudness | 242/157 R X |
| 4,043,623 | 8/1977 | Rausch et al. | 242/157 R X |
| 4,062,484 | 12/1977 | Rausch et al. | 242/157 R X |
| 4,533,968 | 8/1985 | Yoshida et al. | 242/157 R X |
| 4,645,134 | 2/1987 | Sarfati | 242/47.01 |
| 4,794,680 | 1/1989 | Meyerhoff et al. . | |

FOREIGN PATENT DOCUMENTS

| | | |
|---|---|---|
| 0230633 | 8/1987 | European Pat. Off. . |
| 1334286 | 9/1962 | France . |
| 2088527 | 1/1972 | France . |
| 624644 | 8/1981 | Switzerland . |

*Primary Examiner*—Stanley N. Gilreath
*Attorney, Agent, or Firm*—Flynn, Thiel, Boutell & Tanis

[57] ABSTRACT

A yarn storage and feed device for textile machines, comprising a storage body defining a storage surface as well as a winding member for the yarn, the winding member and the storage member being adapted to be rotated relative to each other for transporting the yarn from a feed side of the device onto the storage surface of the storage member and for forming a yarn supply from which the yarn is removed towards the take-off side of the device, and further comprising yarn guide members, which are arranged in the yarn path from the feed area to the take-off area and which are provided with yarn guide surfaces coated with sintered ceramic material or consisting of sintered ceramic material, the yarn being deflected on the yarn guide surfaces at various angles. With regard to particularly advantageous frictional conditions, at least the yarn guide surface (L) having the largest deflection angle (180°-α) is made of a high-density sintered material containing mainly nitride, carbide and/or carbonitride hard materials. This sintered material is formed in an encapsulation in accordance with an isostatic hot-press sintering method for producing thus a yarn guide member.

16 Claims, 2 Drawing Sheets

YARN STORAGE AND FEED DEVICE

DESCRIPTION

Figure 1:
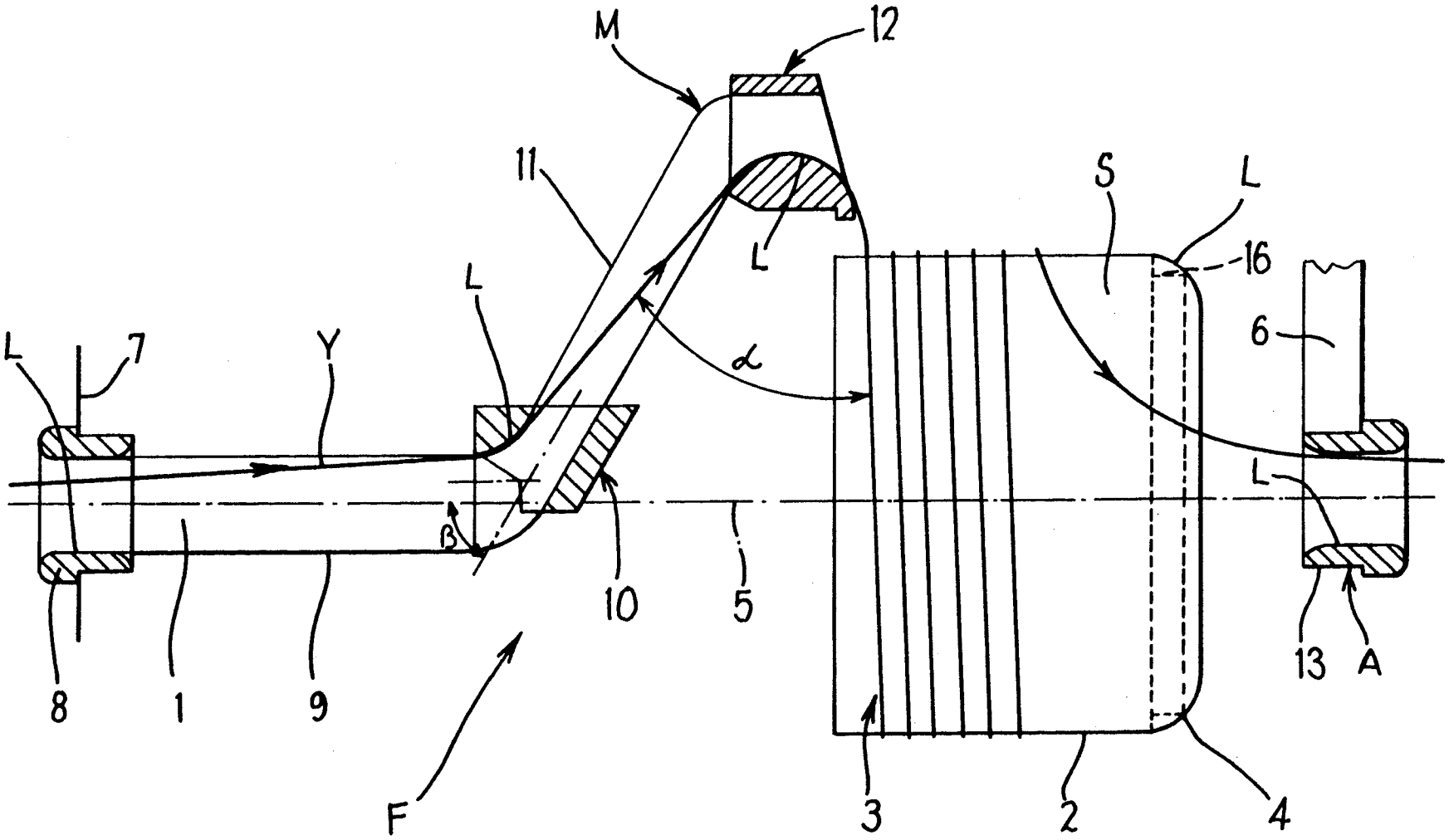

The present invention refers to a yarn storage and feed device.

In yarn storage and feed devices the yarn should be treated as gently as possible along its yarn path through the device and it should be subjected to the smallest possible frictional loads when it comes into contact with components of the device several times. Part of the components of the device rotate relative to the running yarn, the yarn is carried along and deflected, or it circulates relative to stationary components, it oscillates and is subjected to jerky acceleration and deceleration and is moved between spaced guide surfaces in a balloon-forming manner. Yarn guide surfaces, which are coated with sintered ceramic material or which are made of said material, are normally provided at the locations at which yarn contacting is to be expected. Up to this day, conventional abrasion-proof sintered material has been used for this purpose. In spite of increasingly high yarn speeds, e.g. 2,000 m/min and more, a more and more compact structural design is aimed at in the case of modern yarn storage and feed devices for modern textile machines, e.g. jet weaving machines, so that especially the forces acting on the yarn along the yarn path become increasingly important. The quality of a yarn storage and feed device is judged on the basis of its reliability, i.e. the frequency of yarn breaks in operation, since each yarn break will cause a standstill of the textile machine supplied and perhaps of additional systems following said textile machine. Each standstill will result in a loss of production causing high financial losses. Yarn breaks occur predominantly between the feed area and the storage member of the yarn storage and feed device, i.e. in an area where the yarn is normally subjected to friction as well as to a deflection so that it is natural to suspect that there is a connection between the yarn break frequency and the yarn guide surfaces and the influence of the yarn guide surfaces on the yarn.

The object of the present invention is to provide a yarn storage and feed device of the type mentioned at the beginning by means of which the frequency of yarn breaks can be reduced.

In accordance with the present invention, there is provided a yarn storage and feed device for textile machines, comprising a storage body defining a storage surface, a winding member for the yarn, the winding member and the storage member being rotatable in relation to each other for transporting the yarn from a feed side of the device onto the storage surface of the storage member and for forming a yarn supply from which the yarn is removed towards the take-off side of the device, said device further comprising yarn guide members which are arranged in the yarn path from the feed side to the take-off side and formed as moldings and which comprise yarn guide surfaces coated with a ceramic sintered material or composed of a ceramic sintered material, the yarn being deflected on the yarn guide surfaces at various angles, at least the yarn guide surface having a large deflection angle being formed on a high-density sintered molding of hard material made by hot isostatic pressing in an encapsulation.

Surprisingly enough, the frequency of yarn breaks can be reduced by using this sintered material at least in guide surfaces having a large yarn deflection angle. The cause of this surprising improvement is, presumably, that the friction between the yarn and the guide surface is substantially reduced due to the nature of the material used, and this reduced friction will result in smaller mechanical loads on the yarn, and this will have a positive effect on the quality of the yarn storage and feed device especially in the case of higher yarn speeds. Surprisingly enough, it turns out that, in comparison with the friction caused by conventional sintered material, the friction will be reduced for practically all types and qualities of yarn by the use of the present sintered material, i.e. although the frictions which can be measured in the case of a synthetic yarn as well as in the case of a cotton yarn are nominally different, the frictions will in both cases be lower than the friction caused by conventional sintered material. Another point of essential importance with regard to this low friction can be that the yarn guide member including the yarn guide surface is produced in a very specific manner, viz. in accordance with an isostatic hot-press sintering method in an encapsulation. This prerequisite is of importance separately as well as in combination with the selection of the hard material. The hard materials belonging to the group of elements Si, B, Ti, Zr, Hf, V, Nb, Ta, Cr, Mo, W (silicon, boron, titanium, zirconium, hafnium, vanadium, niobium, tantalum, chromium, molybdenum, tungsten), in particular silicon and/or boron, provide the possibility of achieving in the sintered material the sliding properties which are extremely advantageous with regard to the various yarns, also the small grain sizes (approx. 1 micron), which can be obtained in the case of these materials, being, presumably, very important with regard to these sliding properties. The isostatic hot-press sintering process in a capsule prevents foreign substances or substances which would deteriorate the mechanical and thermal properties, respectively, from penetrating into the raw material to be sintered. This, however, also influences the excellent sliding properties of the surface of the yarn guide surface.

Sintered material containing one of the above-mentioned hard materials, e.g. silicon nitride, as a main component is used in various fields of technology, but the decisive prerequisites for the use and for the selection of this extremely expensive sintered material are normally high mechanical loads in combination with strong thermal loads (high-temperature range). This sintered material is, in high-density quality, used e.g. for turbine blades, combustion space linings, nozzles, pump components, valve seats, cutting tool inserts, roller elements for roller bearings, components for beater mills and the like. Cases of use with regard to which neither the high mechanical strength nor the high temperature strength is of importance are not known in connection with this sintered material.

In view of the fact that, for reasons of costs and because of the mechanical loads acting on the yarn and varying in response to the deflection angle and the length of the contact area, among other factors, a selection has to be made from the guide surfaces which may possibly cause yarn breaks. When deflection angle is large, a substantial yarn contact pressure has to be expected, which is of importance with regard to the degree of load to which the yarn will be subjected. In the case of this type of guide surfaces, the low friction of the yarn is particularly important.

The main components of the sintered material are, in principle, components which are normally used with regard to special mechanical loads and/or thermal loads. In a yarn guide surface, however, the extremely low friction, which is, in principle, of secondary importance, but which is extremely important with regard to yarns, is also obtained because ceramic material has a small grain size and is of hard material molded in a high-density. This is, in principle, of benefit to the strength of the material. Silicon nitride proved to be a particularly useful hard material in this respect. Minor additions of boron nitride and/or boron carbide are advantageous. Yttrium oxide as an additive provides the possibility of achieving a high density and good adhesion of the components.

Although the yarn break frequency is reduced by the use of the high-density sintered ceramic material for the guide surfaces having a large yarn deflection angle, e.g. an angle exceeding 90°, it will—in view of the fact that also the other guide surfaces in the yarn path may cause yarn breaks—still be expedient to produce several or all guide surfaces from the high-density sintered material, which contains e.g. silicon nitride as a main component, since this will further reduce the probability of yarn breaks which cannot be localized exactly.

The use of the isostatic hot-pressing method will result in a low surface friction.

An additional expedient embodiment is the case in which the storage member has a cylindrical shape and includes a draw-off edge for the yarn, which serves as a yarn guide surface between the store of yarn and the draw-off area of the device. Also this area of the device can be a critical zone with regard to yarn breaks, especially in cases in which guide surfaces with extremely advantageous sliding properties are already provided upstream and downstream of said area. Hence, it will be advantageous to use in this area, too, the high-density sintered ceramic material containing the above-mentioned hard materials, e.g. silicon nitride, as a main component.

Additional advantageous embodiments relate to the case in which the storage member is arranged such that it stands still and in the case in which the winding member is a pipe member projecting from a hollow main shaft, which is connected to a rotary drive means, radially outwards up to and beyond the storage surface of the neighbouring storage member, the free end of said pipe member having arranged therein the yarn guide member including the guide surface which defines a large deflection angle, e.g. a deflection angle exceeding 90°, for the yarn running from the main shaft to the storage surface. Within the groove nonvarying advantageous sliding conditions exist for the yarn. Also in the case of unavoidable yarn migrating motions, which will occur when the yarn is moving, the contacting length between the yarn and the guide surface will essentially always be the same. There are no sharp edges or projections which might overstress the yarn locally. Optimum sliding conditions exist for the yarn also when said yarn arrives at and moves away from the guide surface. The loads occurring during the yarn deflection process are uniformly distributed over the effective length of the guide surface and due to the low friction, in particular in cases in which silicon nitride is used as hard material main component, they are kept low.

The above-mentioned uniform distribution of the small forces acting on the yarn during the deflection process is specially guaranteed when the radius of curvature does not change.

In another important embodiment, the funnel-shaped trough permits the yarn to carry out a lateral migrating motion without coming into contact with any abrasive edges and since the same yarn guide member can be used for both directions of rotation of the winding member.

Finally, there is an embodiment which is structurally simple and easy to mount. The cylindrical outer section serves to secure the yarn guide member in position. The inner yarn guide surface provided with the collar is responsible for the gentle treatment of the yarn, the yarn coming never into contact with the component of the device on which the yarn guide member is secured in position.

In the case of this type of use of this special sintered material, a secondary effect which is most welcome are the high abrasion resistance and the high mechanical strength, since the yarn guide surfaces will thus not be subjected to any substantial wear even after a long service life and even in cases in which abrasive yarns are used, and since the structural design of the yarn guide members can thus be gracile and, consequently, light, which will result in small inertia forces when said yarn guide members are in motion.

Figures 2, 3A, 3B:
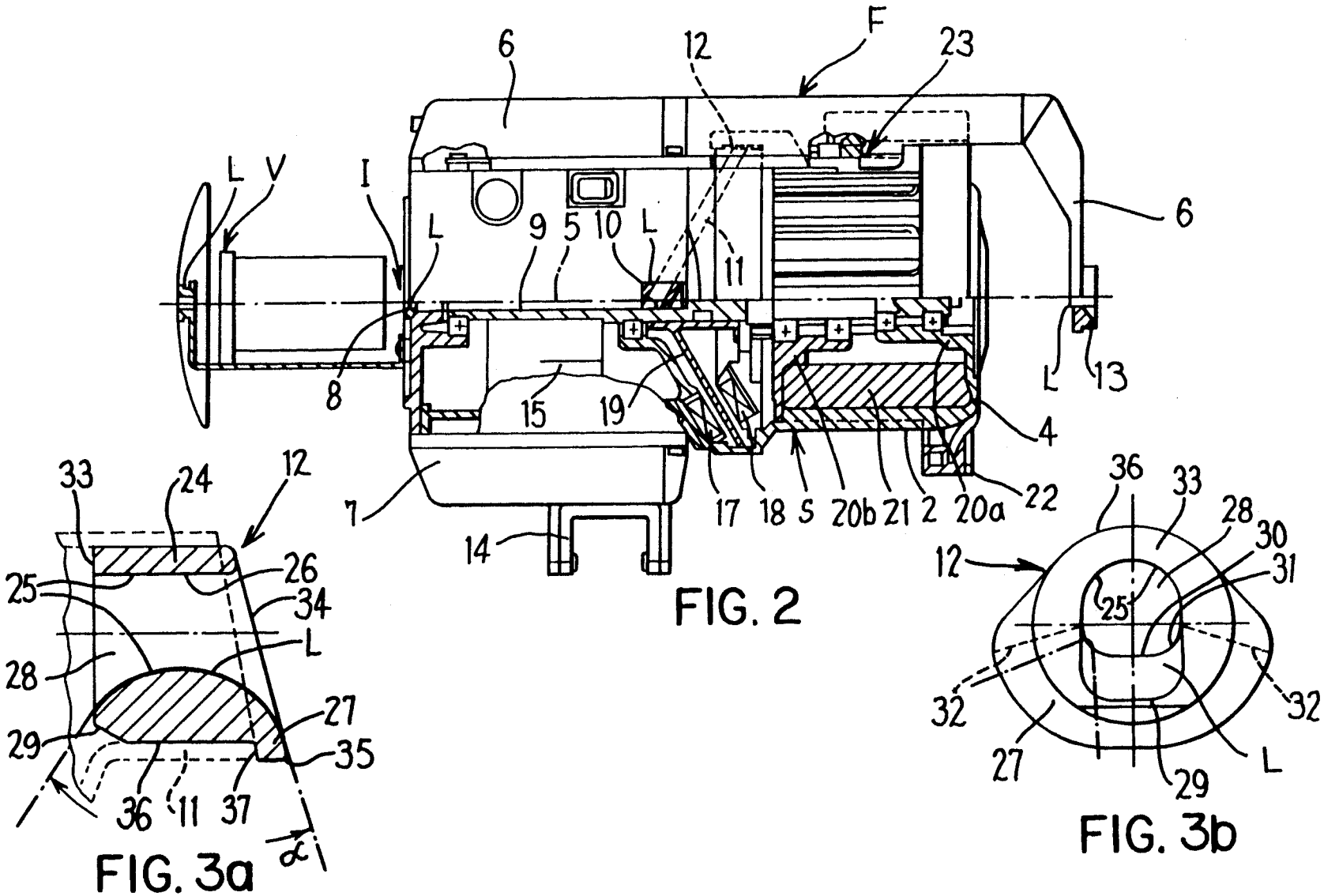

Embodiments of the subject matter of the invention are explained on the basis of the drawing, in which FIG. 1 shows a schematic representation of the yarn path in a yarn storage and feed device, FIG. 2 shows a side view of a yarn storage and feed device, part of said side view being shown in a longitudinal section, and FIGS. 3*a* and 3*b* show associated views, partially in a sectional view, of a yarn guide member of a type adapted to be used in FIGS. 1 and 2.

FIG. 1 schematically outlines a typical yarn path of a yarn Y through a yarn storage and feed device F in order to show how the yarn Y, which is transported in the direction of the arrows, passes several yarn guide surfaces L, which are positioned one after the other in the yarn path, touches said guide surfaces in passing and is deflected whereupon its transport is continued. For storing the yarn in a yarn supply 3 consisting of several yarn windings, the yarn storage and feed device F is provided with a storage member S, which has an e.g. cylindrical shape and the outer circumference of which defines a storage surface 2. Facing a draw-off side A for the yarn, one end portion of the storage member S is provided with a draw-off edge 4 across which the yarn is drawn off and simultaneously deflected. The axis of the device and of the storage member S is provided with reference numeral 5. The yarn Y enters the device approximately in the direction of said axis and leaves the device at the draw-off side again close to said axis. At this location, a yarn guide surface L is provided within a yarn guide member 13, which is constructed e.g. as a yarn eye and which is secured in position in a holding means 6 in a stationary manner. The yarn guide surface positioned at the feed side I is formed in a yarn guide member 8, which is secured in position in a hollow main shaft 9 within the stationary housing 7. A rotary drive means, which is not shown, is connected to the main shaft 9. At the end of the main shaft 9, an additional yarn guide surface L is provided in a yarn guide member 10, which is constructed as a yarn eye and which deflects the direction of movement of the yarn away from the axis 5 at an oblique angle and radially outwards (deflection angle 180°-$\beta$). The main shaft 9 has secured thereto a pipe member 11, which includes an angle $\beta$ with the axis 5 and which is adapted to be rotated together with said main shaft 9, said pipe member 11 projecting outwards up to and beyond the storage surface 2 of the storage member S and being there provided with an additional guide surface L within a yarn guide member 12. The pipe member 11 defines a winding member M, the yarn being drawn off a supply bobbin, which is not shown, and wound onto the storage surface 2 in response to the rotation of said winding member. At the draw-off side A, the yarn is acted upon by a draw-off force, which removes the yarn from the yarn supply 3 as required. The rotational movement of the main shaft 9 and of the winding member M takes place e.g. in response to the size of the yarn supply 3, i.e. as soon as the yarn supply 3 (the number of windings) becomes smaller when the yarn is being removed, the winding member M will again wind yarn windings onto the storage surface 2. Optionally, a yarn advancing member, which is not shown, may be provided, said yarn advancing member advancing the yarn windings in the yarn supply in the direction of the draw-off edge 4. As an alternative possibility, a structural design could be provided in the case of which the storage member S comprises two interengaging cylindrical elements having eccentric axes of rotation which are oblique relative to each other for generating thus an advancing motion for the yarn supply and for causing a separation of the yarn windings. These principles are sufficiently known.

The yarn guide surface L in the yarn guide member 12 defines for the yarn a deflection area having a large deflection angle ($180°-\alpha$), which is in the present case even larger than 90°, said deflection angle having a value between e.g. 175° and 120°, preferably between 150° and 135°, in cases in which $\alpha$ is in the range from 15° to 60°, preferably between 30° and 40°. An additional factor determining the deflection angle is the angle $\beta$ between the axis 5 and the pipe member 11, said angle $\beta$ lying e.g. in the range between 45° and 60°. The yarn Y is not only deflected in a radial plane—as shown in this sectional view—but it is additionally deflected in a direction opposite to the winding direction of the pipe member 11 at an angle which is larger than 90°.

In the case of the schematically outlined embodiment of the yarn storage and feed device F according to FIG. 1, the area of the yarn path between the yarn guide member 10 and the storage surface 2 is a particularly critical area in so far as it is more likely that yarn breaks will occur in this area than in the vicinity of the yarn guide surfaces L of the yarn guide bodies 8 and 13. This is due to the large deflection angles ($180°-\beta$, $180°-\alpha$, and contrary to the direction of winding) and the resultant frictional forces between the yarn and the yarn guide surfaces L.

In order to make the frictional resistance in this critical area low and in order to treat the yarn Y as gently as possible, at least the yarn guide surface L in the yarn guide member 12 is made of a high-density sintered ceramic material containing one or several carbide, nitride or carbonitride hard materials of the following group of elements: Si, B, Ti, Zr, Hf, V, Nb, Ta, Cr, Mo, W, as a main component, preferably silicon nitride whose surface has optimum sliding properties for yarns of every quality (synthetical as well as natural ones). It will be sufficient when the yarn guide surface L is provided with a coating or covering of this high-density sintered material. It will, however, be expedient when the yarn guide member 12 as a whole consists of a formed part which is made of this high-density sintered material and which is produced by isostatic hot-pressing in a capsule. The isostatic hot-pressing can also be carried out in a suitable moulding cavity without using any capsule.

In view of the fact that the yarn, when running along its yarn path, is also deflected on the other yarn guide surfaces and rubs against said surfaces, it will be expedient when also the other yarn guide surfaces, at least those having a major deflection angle, are made of the same high-density sintered material containing e.g. silicon nitride as a main component. The same applies to the draw-off edge 4 of the storage member S where a coating or an insert ring 16 of high-density sintered material is provided for forming the yarn guide surface L across which the yarn slides upon being removed and deflected towards the axis 5. In the case of this embodiment, the storage member S standstill, whereas the winding member M rotates. It is, however, also imaginable to select an operating principle which functions the other way round and in the case of which the winding member stands still, whereas the storage member S rotates. Due to the structural design employed, a yarn guide surface L close to or at the draw-off side A will then often be the yarn guide surface which is critical with regard to yarn breaks and which has a larger deflection angle.

On the basis of FIG. 2, a yarn storage and feed device F is described which is suitable for being used in practice and which operates in accordance with the above-mentioned functional principle of FIG. 1. Corresponding components are provided with the reference numerals which have been used in FIG. 1.

The housing 7, in which the main shaft 9 as well as the storage member S are rotatably supported, is secured to a support member, which is not shown, with the aid of a holding means 14. The housing 7 has provided therein a drive motor 15 for the main shaft 9 plus the pipe member 11. Furthermore, magnets 17 are distributed within the housing, said magnets 17 being in alignment with magnets 18 connected to the storage member S, which is, in principle, adapted to be rotated on the main shaft 9, and maintaining the storage member S in a stationary condition when the main shaft 9 rotates. A winding cone 19, which is connected to the main shaft 9, extends between the magnets 17 and 18, said winding cone 19 having attached thereto the pipe member 11 in the free end of which the yarn guide member 12 including the guide surface L, which has here the largest deflection angle ($180°-\alpha$), is provided in such a way that the yarn moving out of the pipe member 11 in an oblique radial direction is placed substantially tangentially onto the storage surface 2 of the storage member S in a direction opposite to the winding direction. The storage member S comprises two interengaging rod cage halves **20*a* and 20*b*, the axis of rotation of the rod cage half 20*b* being in alignment with the axis 5, whereas the axis of rotation of the rod cage half 20*a* is arranged such that it is eccentric and inclined relative to the axis 5 so as to generate an advance movement for the yarn windings in the yarn supply, which is not shown. In the interior of the storage member S, a filler 21** is provided, which prevents an ingress of contaminations.

The draw-off edge 4 of the storage member S has associated therewith a brake ring 22 forming with elastic members—in a known manner—a retardation means for the yarn take-off point which circulates during the yarn take-off process. The housing 7 has provided thereon the longitudinally extending holding means 6 for the yarn guide member 13, said holding means 6 having additionally provided therein a sensor means 23 used for monitoring the size of the yarn supply.

The yarn guide member 8 is preceded by a supplementary unit V containing an additional yarn guide surface L on its inlet side. The supplementary unit can, for example, be a yarn motion monitoring device or a feeler unit. The yarn guide member 10 is accommodated within the hollow main shaft 9 and connects the passage in said main shaft 9 with the pipe member 11. In the case of this embodiment, the highest degree of deflection along the yarn path occurs within the yarn guide member 12 along the yarn guide surface L, in accordance with FIG. 1. In the case of other embodiments, however, the strongest degree of deflection may also occur at a different yarn guide surface.

At least the yarn guide surface L within the yarn guide body 12 is made of high-density sintered material containing e.g. silicon nitride as a main component. However, also the other yarn guide surfaces L provided along the yarn path may consist of the same material.

FIGS. 3*a* and 3*b* show a special embodiment of the yarn guide member 12 of FIGS. 1 and 2 more clearly. The yarn guide member 12, which consists of a high-density sintered material containing e.g. silicon nitride as the main component, is provided with a sleevelike basic body 24 having a continuous passage 28 with inner walls 25. A straight wall portion 26 extends at the upper side of the passage 28, this being the location where contact with the yarn will normally hardly occur. At the lower side of the passage 28, the yarn guide surface L, which shows a continuous uniform curvature, is formed as a convex groove 30, which starts, with comparatively narrow dimensions, at a shoulder 29 and which is provided with rounded flanks 31 on its sides. After the highest point of the yarn guide surface L, said yarn guide surface descends outwards until it finally ends in an oblique collar 27 circumferentially extending at least along part of the periphery of the basic body 24. The passage end section facing the collar 27 widens in a funnel-shaped manner and defines a trough 32 (whose limits are indicated by the broken line) so as to guarantee easy yarn withdrawal in a direction opposite to the winding direction, this yarn withdrawal being guaranteed independently of the direction of rotation of the main shaft 9. The oblique end face of the collar 27 is provided with reference numeral 34, whereas the rear end face, which extends at right angles to the axis of the sleevelike basic body 24, is provided with reference numeral 33. The outer periphery of the basic body 24 is provided with a cylindrical portion 36 so that the yarn guide body 12 can be inserted in the pipe member 11. The back of the collar 27 defines an insertion limiting means 37. The yarn guide member 12 can be secured in position in the pipe member by means of a press fit. It would, however, also be possible to fasten said yarn guide member 12 with glue or with the aid of locking means. An important point is that the yarn (indicated by the dot-and-dash line) runs onto and away from the yarn guide surface L in an approximately tangential direction at the starting section and at the end section of said yarn guide surface L and that the radius of curvature of said yarn guide surface remains substantially the same throughout the yarn guide surface length so as to make the frictional forces to which the yarn is subjected uniform.

The yarn guide member 12 is a formed part made of a high-density sintered material containing e.g. silicon nitride as the main component. Optionally, the sintered material additionally contains between 1% by volume and 8% by volume, preferably approx. 2.5%, of boron nitride and/or boron carbide and/or yttrium oxide as an additive. The yarn guide member 12 is in this form produced by isostatic hot-press sintering in a mould cavity or in an encapsulation, e.g. a glass encapsulation; in said glass encapsulation, a preform consisting of ceramic raw material is covered with a boron carbide or a boron nitride layer so as to prevent undesirable glass components or other components from penetrating into the preform. Normally, a suspension of silicon nitride powder is first formed for eliminating coarser grains so that only grain sizes of approx. 1 micron will remain in the preform, said grain sizes being, in the final analysis, one of the factors which are responsible for the high density and the smoothness of the finished product. The preform is formed, under moderate pressure and at a low temperature, from the mass of small silicon nitride grains, which can have added thereto conventional additives for sintered ceramic material, the dimensions of said preform being still slightly larger than the final dimensions of the yarn guide body 12. The thus compacted preform is then inserted e.g. in the above-mentioned glass encapsulation and pressure is applied thereto, said pressure being maintained constant throughout the hot-press sintering process. Subsequently, a high temperature is applied during a period of time of considerable length for the purpose of sintering, and then the encapsulation is removed and the surface is cleaned so as to remove residues of the capsule. The yarn guide member 12 is now ready for use.

A yarn guide member 12 according to FIGS. 3*a*, 3*b* was used for tests carried out for the purpose of determining the static frictional force and the coefficient of friction for two types of yarns.

EXAMPLE 1

The angle $\beta$ (FIG. 1) was 45°, whereas the deflection angle was $(180°-\alpha)=157°$ or the angle was 23°. The value measured was the ratio between F1 and F2, this ratio being equal to the value $e^{\mu}$. The force F1 occurred in the yarn between the yarn guide member 12 and the storage surface 2. The force F2 occurred in the yarn between the yarn guide member 10 and the yarn guide member 12. Conventional sintered ceramic material of the type hitherto used for yarn guide surfaces resulted in a value of 1.88 for F1:F2 in the case of a yarn having a conventional yarn number, whereas the same yarn guide surface L made of high-density sintered material, which contained silicon nitride as a main component and approx. 2.5% boron carbide or yttrium oxide, resulted in a value of 1.64. This means an improvement by approx. 12.7%.

In the case of a synthetic filament yarn having a conventional yarn number, a value of 2.21 was obtained when the customary ceramic material was used, whereas the same guide surface made of the above-mentioned high-density sintered material resulted in a value of 1.98 for the same yarn. This means an improvement by approx. 10.4%.

EXAMPLE 2

In the case of an angle $\beta$ of 60° and a deflection angle of 177° ($\alpha=13°$), a value of 2.04 was obtained when a guide surface of conventional sintered ceramic material was used for a cotton yarn having a conventional yarn number, whereas the use of the same yarn on the same guide surface, which consisted of high-density sintered material containing silicon nitride as the main component and approx. 2.5% by volume of boron carbide or yttrium oxide, resulted in a value of 1.75. This means an improvement by approx. 14.2%.

Under the same conditions, a value of 2.45 was obtained in the case of a synthetic filament yarn having a conventional yarn number, whereas the high-density sintered material resulted in a value of 2.17. This means an improvement by approx. 11.4%.

EXAMPLE 3

Determination of the Coefficient of Friction

In order to determine the coefficient of friction, the test was carried out with a yarn length of 2×20 cm and a load of approx. 30 cN, and the yarn guide member as well as the yarn used for the test were cleaned with alcohol after each test cycle. A PES yarn, i.e. a polyester or nylon yarn, and a cotton yarn were used for the test; each of said yarns was drawn across the yarn guide surface under load at a first speed of 100 mm/min and, subsequently, at a second speed of 1000 mm/min.

Three test cycles were carried out at each speed and with each yarn.

In the course of these tests, the coefficient of friction obtained for the cotton yarn showed the tendency to decrease slightly with each passing test cycle, whereas the coefficient of friction obtained for the PES yarn increased slightly with each passing test cycle.

The following individual average values were ascertained on the basis of the three test cycles which were carried out respectively:

| PES | HD-SiN sintered material | convent. sintered material (type 1) ($Al_2O_3$) | convent. sintered material (type 2) |
|---|---|---|---|
| 100 mm/min | 0.263 | 0.292 | 0.292 |
| 1000 mm/min | 0.246 | 0.286 | 0.270 |
| cotton | | | |
| 100 mm/min | 0.148 | 0.235 | 0.205 |
| 1000 mm/min | 0.175 | 0.235 | 0.230 |

These tests show clearly that, in spite of the extreme deflection angle chosen for the tests, the yarn is mechanically treated much more gently by yarn guide surfaces made of sintered material, which contain silicon nitride as the main component, than it would be treated on yarn guide surfaces consisting of conventional sintered material. This gentle treatment of the yarn results in a reduction of the yarn breaks which have hitherto taken place predominantly in the yarn path area in which the highest degree of deflection and, consequently, the strongest mechanical load on the yarn existed. This applies to all yarn numbers and to all qualities of yarns which are processed by such yarn storage and feed devices.

Moreover, the mechanical abrasion resistance of the high-density sintered material containing silicon nitride as the main component guarantees a long service life without any perceivable wear even in the case of specially abrasive yarns and the high mechanical strength of the sintered material provides the possibility of constructing the yarn guide members such that they are very gracile and light, and this will result in desirably small moving masses in particular in the case of the yarn guide member provided within the winding member. An additional, positive aspect of the high-density sintered material is that the yarn guide surfaces contribute to a uniform yarn take-off tension which is as small as possible, such a yarn take-off tension being advantageous in connection with modern textile machines.

We claim:

1. In a yarn storage and feed device for a textile machine, said device having a feed side, a take-off side and a storage body disposed between said feed side and said take-off side, said storage body having a storage surface for storing a length of yarn, a winding member for winding the yarn on said storage surface, means supporting said winding member and said storage body for relative rotation for transporting the yarn through a yarn path extending from said feed side to said storage surface and thence extending from said storage surface to said take-off side, yarn guide members having yarn guide surfaces disposed along said yarn path for slidable engaging and guiding the movement of the yarn, at least one of said yarn guide surfaces being effective for changing the direction of travel of the yarn through a large deflection angle, the improvement which comprises: said one yarn guide surface is formed of a high-density, sintered molding of hard ceramic material, said molding having been made by isostatic hot pressing in an encapsulation, said one yarn guide surface exhibiting low friction to yarn moving thereacross and being effective to minimize yarn breaks.

2. A yarn storage and feed device according to claim 1, wherein said sintered molding contains, as a main component, at least one hard ceramic material which is a ceramic compound of an element selected from the group consisting of:

Si, B, Ti, Zr, Hf, V, Nb, Ta, Cr, Mo and W.

3. A yarn storage and feed device according to claim 1, wherein said one yarn guide surface has a deflection angle exceeding 90°.

4. A yarn storage and feed device according to claim 1, wherein said sintered molding contains, as a main component, at least one ceramic compound selected from the group consisting of the nitrides, carbides and carbonitrides of Si, B, Ti, Zr, Hf, V, Nb, Ta, Cr, Mo and W.

5. A yarn storage and feed device according to claim 1, wherein said high-density sintered molding, which forms said one guide surface, consists essentially of from 1% by volume to 8% by volume of an additive selected from the group consisting of boron nitride, boron carbide, yttrium oxide and mixtures thereof, and the balance is silicon nitride.

6. A yarn storage and feed device according to claim 1, in which at least one additional yarn guide surface along the guide path is formed of a second high-density sintered molding of hard ceramic material made by hot isostatic pressing in an encapsulation.

7. A yarn storage and feed device according to claim 6, wherein said sintered moldings contain, as a main component, at least one hard ceramic material which is a ceramic compound of an element selected from the group consisting of:

Si, B, Ti, Zr, Hf, V, Nb, Ta, Cr, Mo and W.

8. A yarn storage and feed device according to claim 6, wherein said sintered moldings contain, as a main component, at least one ceramic compound selected from the group consisting of the nitrides, carbides and carbonitrides of Si, B, Ti, Zr, Hf, V, Nb, Ta, Cr, Mo and W.

9. A yarn storage and feed device according to claim 1, wherein said storage body has a cylindrical shape and comprises a yarn draw-off edge serving as a yarn guide surface, and wherein said yarn guide surface of said draw-off edge is made of a high-density hard sintered material made by hot isostatic pressing in an encapsulation.

10. A yarn storage and feed device according to claim 9, wherein said yarn guide surface of said draw-off edge is made of a high-density sintered molding and contains, as a main component, at least one or several hard ceramic material which is a ceramic compound of an element selected from the following group:

Si, B, Ti, Zr, Hf, V, Nb, Ta, Cr, Mo and W.

11. A yarn storage and feed device according to claim 9, wherein said yarn guide surface of said draw-off edge is made of a high-density sintered material which contains, as a main component, at least one ceramic compound selected from the group consisting of the nitrides, carbides and carbonitrides of Si, B, Ti, Zr, Hf, V, Nb, Ta, Cr, Mo and W.

12. A yarn storage and feed device according to claim 1, wherein said storage body is stationary and said winding member is a pipe member, a hollow main shaft from which said pipe member extends, a rotary drive means connected for rotating said main shaft, said pipe member extending approximately radially outwards up to and beyond the storage surface of said storage body, the free end of said pipe member having provided therein a yarn guide member including a guide surface which defines a deflection angle exceeding 90° for the yarn moving out of said main shaft and towards said storage surface, wherein said yarn guide member of said pipe member is a high-density sintered molding having an internal passage, said yarn guide surface of said pipe member is formed on the wall of said passage as a convex groove whose starting and end sections are approximately in alignment with the direction in which the yarn moves toward and away from said yarn guide member of said pipe member.

13. A yarn storage and feed device according to claim 12, wherein the curvature of said groove, when seen in a longitudinal section through said yarn guide member of said pipe member, has a uniform radius of curvature throughout the deflection angle.

14. A yarn storage and feed device according to claim 12, wherein the end section of said groove is a funnel-shaped trough which, when seen relative to the centre of the passage, extends over approximately 160° (radian measure).

15. A yarn storage and feed device according to claim 12, wherein said yarn guide member of said pipe member is constructed as a sleeve having a cylindrical outer portion and a collar inclined relative to the axis of said outer portion, which collar as a border of the trough projects outwards at least over part of the periphery of the cylindrical portion and defines an insertion limiting means for the yarn guide member of said pipe member.

16. A yarn storage and feed device according to claim 1 in which said high-density sintered molding, which forms said one guide surface, consists essentially of about 2.5% by volume of an additive selected from the group consisting of boron nitride, boron carbide, yttrium oxide and mixtures thereof, and the balance is silicon nitride having a particle size of about 1 micron.

* * * * *